US009431705B2

(12) United States Patent
Basirat

(10) Patent No.: US 9,431,705 B2
(45) Date of Patent: Aug. 30, 2016

(54) ANTENNA ARRANGEMENT AND DEVICE

(71) Applicant: LITE-ON MOBILE OYJ, Vantaa (FI)

(72) Inventor: Parviz Basirat, Lund (SE)

(73) Assignee: GUANGZHOU LITE-ON MOBILE ELECTRONIC COMPONENTS CO., Guangzhou (CN)

( * ) Notice: Subject to any disclaimer, the term of this patent is extended or adjusted under 35 U.S.C. 154(b) by 137 days.

(21) Appl. No.: 14/356,346

(22) PCT Filed: Nov. 1, 2012

(86) PCT No.: PCT/FI2012/051061

§ 371 (c)(1),
(2) Date: May 5, 2014

(87) PCT Pub. No.: WO2013/064743

PCT Pub. Date: May 10, 2013

(65) Prior Publication Data

US 2014/0333504 A1 Nov. 13, 2014

(30) Foreign Application Priority Data

Nov. 4, 2011 (FI) ..... 20116089

(51) Int. Cl.

| | |
|---|---|
| ***H01Q 21/00*** | (2006.01) |
| ***H01Q 5/00*** | (2015.01) |
| ***H01Q 1/24*** | (2006.01) |

(Continued)

(52) U.S. Cl.

CPC ..... *H01Q 5/0062* (2013.01); *H01Q 1/243* (2013.01); *H01Q 1/36* (2013.01); *H01Q 1/362* (2013.01); *H01Q 5/25* (2015.01); *H01Q 5/378* (2015.01);

(Continued)

(58) Field of Classification Search

CPC ..... H01Q 1/362; H01Q 9/42; H01Q 1/243
USPC ..... 343/702, 895, 893
See application file for complete search history.

(56) References Cited

U.S. PATENT DOCUMENTS 6,326,921 B1 12/2001 Egorov et al.
6,392,610 B1 * 5/2002 Braun ..... H01Q 1/243 343/700 MS (Continued)

FOREIGN PATENT DOCUMENTS

CN 1701465 A 11/2005
EP 1 538 703 A1 6/2005

(Continued)

OTHER PUBLICATIONS

Jun. 23, 2015 extended Search Report issued in European Patent Application No. 12846181.1.

(Continued)

*Primary Examiner* — Dameon E Levi
*Assistant Examiner* — Hasan Islam
(74) *Attorney, Agent, or Firm* — Li & Cai Intellectual Property (USA) Office

(57) ABSTRACT

An antenna arrangement of an electronic device and a device is disclosed. The antenna arrangement includes two radiator elements. The first radiator element of the two radiator elements is connected to a feed element. A second radiator element of the two radiator elements is a passive element and connected to a ground plane. The first radiator element is arranged to feed the second radiator element by radiating energy.

12 Claims, 9 Drawing Sheets

(51) Int. Cl.

| | |
|---|---|
| ***H01Q 1/36*** | (2006.01) |
| ***H01Q 9/42*** | (2006.01) |
| ***H01Q 5/25*** | (2015.01) |
| ***H01Q 5/378*** | (2015.01) |
| ***H01Q 5/385*** | (2015.01) |
| ***H01Q 5/40*** | (2015.01) |

(52) U.S. Cl.
CPC ..... *H01Q 5/385* (2015.01); *H01Q 5/40* (2015.01); *H01Q 9/42* (2013.01); *H01Q 21/00* (2013.01)

(56) References Cited

U.S. PATENT DOCUMENTS

| | | | | |
|---|---|---|---|---|
| 2003/0169206 | A1* | 9/2003 | Egawa | H01Q 1/242 343/702 |
| 2003/0210206 | A1 | 11/2003 | Phillips et al. | |
| 2005/0195124 | A1* | 9/2005 | Puente Baliarda | H01Q 1/36 343/893 |
| 2005/0248489 | A1 | 11/2005 | Kim et al. | |
| 2006/0152411 | A1* | 7/2006 | Iguchi | H01Q 1/36 343/700 MS |
| 2008/0180330 | A1 | 7/2008 | Wei-Shan et al. | |
| 2009/0219220 | A1 | 9/2009 | Kersten et al. | |
| 2009/0256759 | A1* | 10/2009 | Hill | H01Q 1/243 343/702 |
| 2010/0026595 | A1 | 2/2010 | Kondo et al. | |
| 2010/0207832 | A1 | 8/2010 | Ying et al. | |
| 2010/0289717 | A1* | 11/2010 | Arslan | H01Q 1/38 343/876 |

FOREIGN PATENT DOCUMENTS

| | | | |
|---|---|---|---|
| JP | A-2002-344222 | | 11/2002 |
| WO | 01/63690 | A2 | 8/2001 |
| WO | WO 2006/020923 | A2 | 2/2006 |
| WO | WO 2010/122220 | A1 | 10/2010 |

OTHER PUBLICATIONS

May 25, 2015 Office Action issued in Chinese Patent Application No. 201280053980.0.

International Search Report issued in International Patent Application No. PCT/FI2012/051061 mailed Feb. 28, 2013.

Search Report issued in Finnish Patent Application No. 20116089 dated Jun. 13, 2012.

* cited by examiner

ANTENNA ARRANGEMENT AND DEVICE

BACKGROUND

The invention relates to an antenna arrangement comprising two radiator elements.

The invention further relates to an electronic device, comprising at least two radiator elements.

The demand for wireless communication using multiple frequency bands increases all the time.

A problem with this is that conventional antenna arrangements cannot cover especially low frequency bands without use of active components such as switches.

BRIEF DESCRIPTION

Viewed from a first aspect, there can be provided an antenna arrangement comprising a first radiator element of said two radiator elements connected to a feed element, a second radiator element of said two radiator elements being a passive element and connected to a ground plane, the first radiator element arranged to feed the second radiator element by radiating energy.

Thereby a simple antenna arrangement having ability to cover low frequency bands may be achieved.

Viewed from a further aspect, there can be provided an electronic device, comprising a first radiator element of said two radiator elements connected through a feed element to electronics of the electronic device, a second radiator element of said two radiator elements being a passive element and connected to a ground plane in the electronic device, the first radiator element arranged to feed the second radiator element by radiating energy.

The invention may also provide the advantage that the antenna is implemented in a space-saving way in an electronic device.

An embodiment of the invention may also provide the advantage that a wide range of frequency bands is covered.

The antenna arrangement and the electronic device are characterised by what is stated in the characterising parts of the independent claims. Some other embodiments are characterised by what is stated in the other claims. Inventive embodiments are also disclosed in the specification and drawings of this patent application. The inventive content of the patent application may also be defined in other ways than defined in the following claims. The inventive content may also be formed of several separate inventions, especially if the invention is examined in the light of expressed or implicit sub-tasks or in view of obtained benefits or benefit groups. Some of the definitions contained in the following claims may then be unnecessary in view of the separate inventive ideas. Features of the different embodiments of the invention may, within the scope of the basic inventive idea, be applied to other embodiments.

In a preferred structure, the antenna arrangement comprises two radiator elements, wherein a first radiator element of said two radiator elements connected to a feed element, a second radiator element of said two radiator elements being a passive element and connected to a ground plane, the first radiator element arranged to feed the second radiator element by radiating energy.

In one embodiment the first radiator element is a helix element.

In one embodiment the second radiator element is an inverted L element.

In one embodiment the second radiator element is a meandering element.

In one embodiment the first radiator element is matched to 50 Ohm through the second radiator element.

In one embodiment the antenna arrangement comprises two first radiator elements and two second radiator elements constructing two antennae.

In another preferred structure, an electronic device comprises at least two radiator elements, wherein a first radiator element of said two radiator elements connected through a feed element to electronics of the electronic device, a second radiator element of said two radiator elements being a passive element and connected to a ground plane in the electronic device, and the first radiator element arranged to feed the second radiator element by radiating energy.

In one embodiment the first radiator element is a helix element.

In one embodiment the second radiator element is an inverted L element.

In one embodiment the second radiator element is a meandering element.

In one embodiment the first radiator element is matched to 50 Ohm through the second radiator element.

In one embodiment the electronic device comprises two first radiator elements and two second radiator elements constructing two antennae.

In one embodiment the main axis of the first radiator element is arranged parallel with the width of the electronic device.

In one embodiment the main axis of the first radiator element is arranged parallel with the length of the electronic device.

BRIEF DESCRIPTION OF FIGURES

Some embodiments illustrating the present disclosure are described in more detail in the attached drawings, in which.

In the figures, some embodiments are shown simplified for the sake of clarity. Similar parts are marked with the same reference numbers in the figures.

DETAILED DESCRIPTION

Figure 1A:
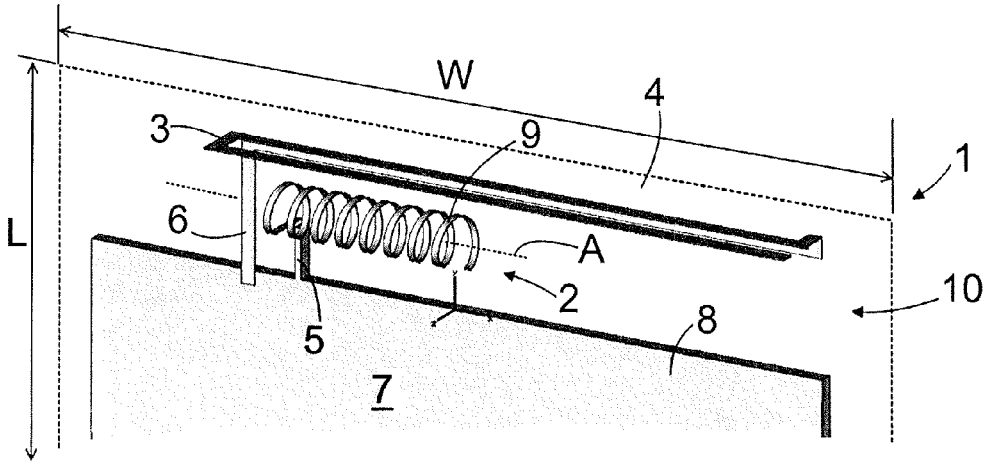
FIG. 1*a* is a schematic perspective view of an example antenna arrangement and an electronic device.
Figure 1B:
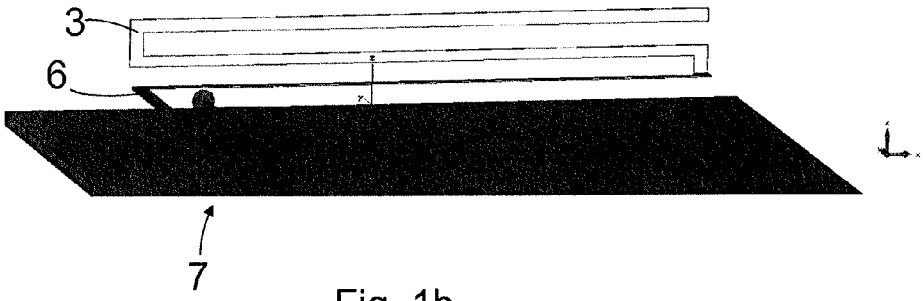
FIG. 1*b* is another schematic perspective view of the example antenna arrangement and electronic device shown in FIG. 1*a*.
Figure 1C:
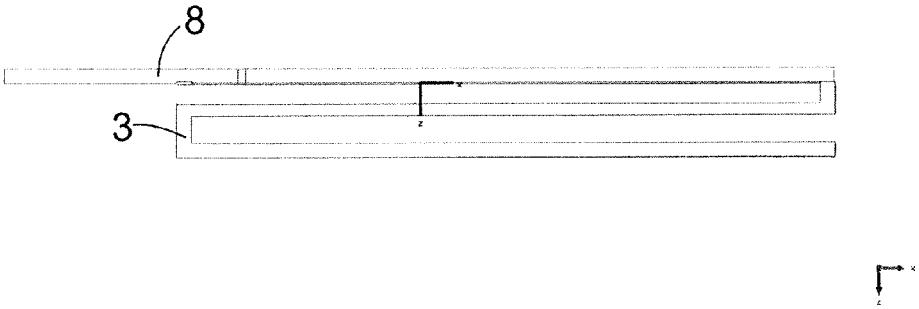
FIG. 1*c* is a schematic side view of the example antenna arrangement and electronic device shown in FIGS. 1*a* and 1*b*.

FIG. 1*a* is a schematic perspective view, FIG. 1*b* is another schematic perspective view, and FIG. 1*c* is a schematic side view of an example antenna arrangement and electronic device.

The antenna arrangement 1 is a part of an electronic device 4 that is depicted by dash line in FIG. 1*a*.

The electronic device 4 may be a mobile phone, some other portable or fixedly positioned communication means that functions at least partially wirelessly, such as a communicator, or some other portable electronic device, such as a palmtop computer, portable computer, game console or controller, playback device for audio and/or visual material, pulse counter, code reader, transmitter and/or receiver intended for measuring purposes and functioning wirelessly, or the like.

The antenna arrangement 1 constructs an antenna 10 that comprises two radiator elements, that is a first radiator element 2 and a second radiator element 3. It is to be noted, however, that the antenna arrangement 1 may comprise more than two radiator elements, and also more than one antenna 10.

Figure 12:
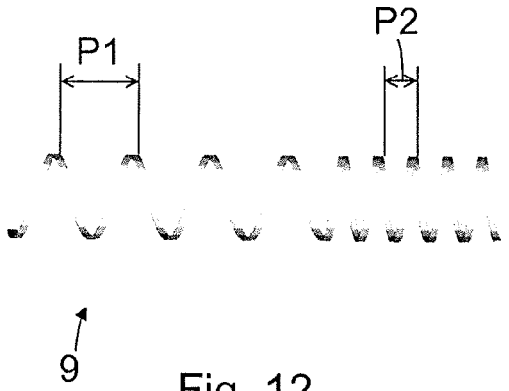
FIG. 12 is a schematic side view of an example helix element.

The first radiator element 2 comprises a helix element 9. The helix element is made of an electrically conductive material such as metal strip or wire that is wound in a helical configuration. The helical configuration may lay on a core element (not shown in Figures). Dimensions of the helix element 9 may vary. The length is preferably within range of 5-30 mm and diameter 3-5 mm. The helix element comprises at least one turn of strip or wire, but preferably 2-10 turns, or even more. FIG. 12 is a schematic side view of an example helix element. The helix element 9 comprises two helix sections. The pitch space P1 of first helix section is larger than the pitch space P2 of second helix section. P1 may be, for instance, 3.2 mm and P2, for instance, 1.2 mm. This kind of double pitch helix may generate two resonances which make possible to design a single feed antenna arrangement that covers two frequency bands, one for lower frequency bands, for example for GSM 850 and/or GSM900, and other for higher frequency bands, such as GSM 1800 and/or 1900 and/or UMTS. According to another embodiment the pitch space of the helix element 9 may be constant on all its length.

The main axis A of the first radiator element 2 is parallel with the width direction W of the electronic device 1. According to another embodiment, the main axis A may be arranged parallel with the length direction L of the electronic device 1. According to still another embodiment, the main axis A may be arranged parallel with an axis that is not parallel with the width direction W nor the length direction L of the electronic device 1. The main axis A may also be arranged parallel with height of the device cover, i.e. orthogonally to directions L and W.

The first radiator element 2 is connected to a feed element 5 to electronics of the electronic device 1, i.e. to antenna port of the device. Said electronics may be arranged to a circuit board 8, such as PWB (Printed Wiring Board). The feed element 5 is configured to reception and/or transmission of electromagnetic signals at particular frequencies.

The feed element 5 shown in FIGS. 1*a*-1*c* is a galvanic coupling element. Alternatively, the feed element 5 may comprise a capacitive or inductive coupling between the first radiator element 2 and the antenna port.

The feed element 5 may comprise a matching element and/or a diplexer. Matching elements, if any, for matching the resonance frequency range of the first radiator element 2 are preferably arranged to near to the antenna port.

It is to be noted here that the first radiator element 2 needs not to be a helix but also some another antenna configuration may be utilized.

The second radiator element 3 is connected to a ground plane 7 through a grounding element 6. The ground plane 7 may be arranged e.g. to the circuit board 8 of the device.

The second radiator element 3 is not directly connected to an antenna port. The second radiator element 3 is a passive element that is fed by radiating energy generated in the first radiator element 2. In an embodiment a first resonance generated by the first radiator element 2 and a second resonance generated by the second radiator element 3 may be combined to a resonance.

The first radiator element 2, or resonance thereof is matched to e.g. 50 Ohm or other suitable impedance through the second radiator element 3.

According to an idea of the invention, the first and the second radiator elements 2 transmit and/or receive the radiating energy processed through the antenna 10.

The type of the second radiator element 3 shown in FIGS. 1*a*-1*c* is an inverted L element.

The radiator elements 2, 3 may be made of sheet of metal, such as aluminium, zinc, steel, stainless steel, magnesium, copper or an alloy.

Alternatively, the material of the radiator element 2, 3 may be an electrically conductive plastic or plastic mixture made electrically conductive by doping a conductive material (metal, ceramics, carbon in various forms, etc.) in it. The radiator element 2, 3 may also be manufactured of any combinations of materials listed above, e.g. as a combination of metal and plastic.

Figure 2A:
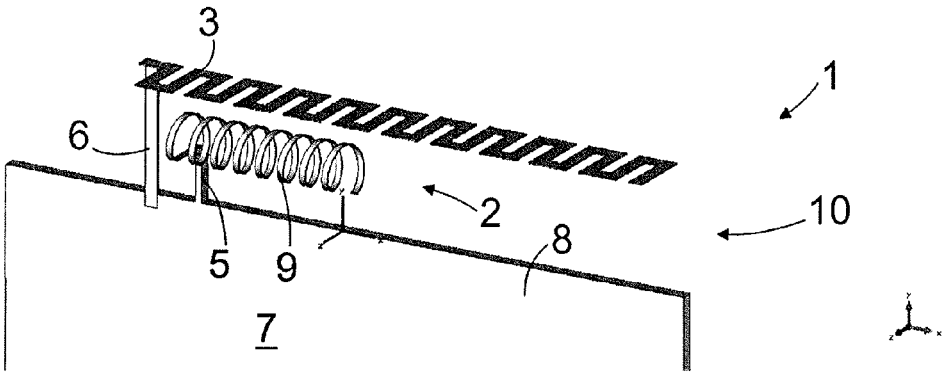
FIG. 2*a* is a schematic perspective view of another example antenna arrangement and an electronic device.
Figure 2B:
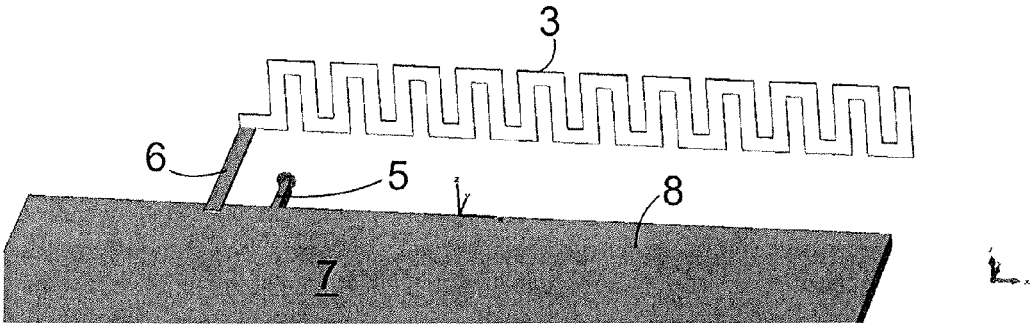
FIG. 2*b* is another schematic perspective view of the example antenna arrangement and electronic device shown in FIG. 2*a*.
Figure 2C:
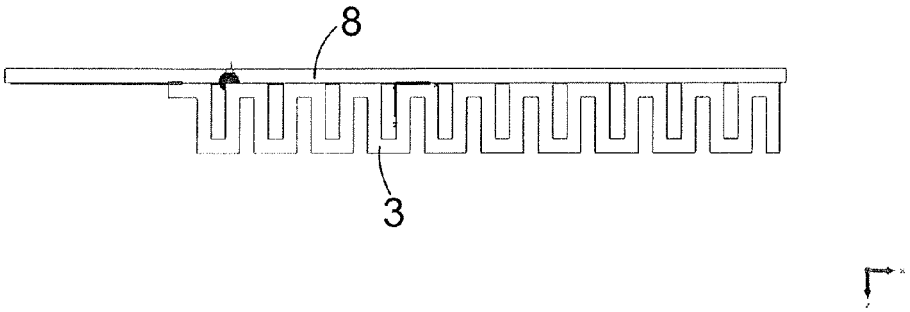
FIG. 2*c* is a schematic side view of the example antenna arrangement and electronic device shown in FIGS. 2*a* and 2*b*.

FIG. 2*a* is a schematic perspective view of another example antenna arrangement and an electronic device, FIG. 2*b* is another schematic perspective view thereof, and FIG. 2*c* is a schematic side view thereof.

The second radiator element 3 is now a meandering element. The meandering-type element is especially advantageous to extend resonance length and frequency range of the antenna arrangement. It is to be noted that the second radiator element 3 may also have any appropriate shape or antenna type that fit in the electronic device 4. Thus the second radiator element 3 may have an antenna shape like folded dipole antenna, loop antenna, F shape antenna, PIFA antenna etc. Connections to the electronics of the device, grounding of the second radiator element 3 and features of the first radiator element may be realized as discussed in context with FIGS. 1*a*-1*c*.

Figure 3:
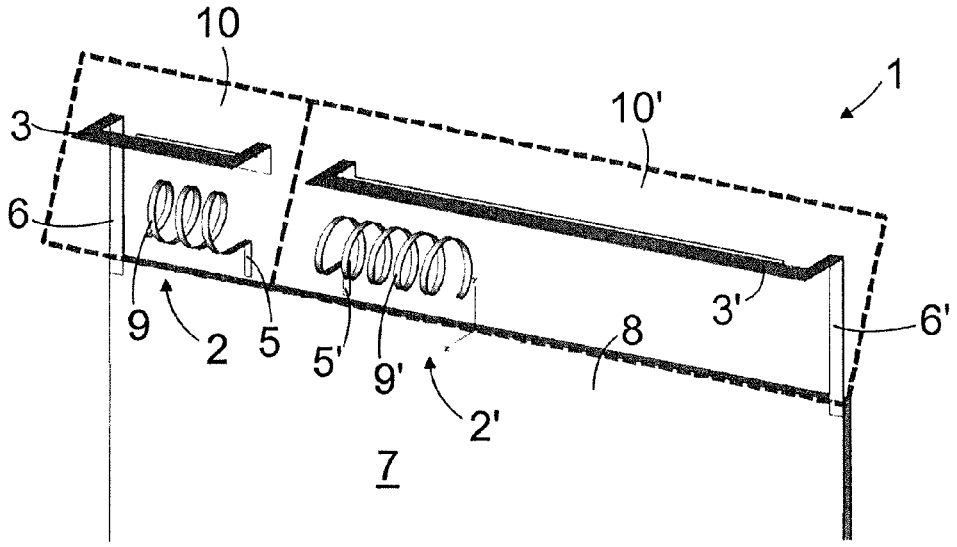
FIG. 3 is a schematic perspective view of third example antenna arrangement.

FIG. 3 is a schematic perspective view of third example antenna arrangement. In the embodiments shown in FIGS. 1*a*-2*c*, the antenna arrangement 1 comprises one first radiator element 2 and one second radiator element 3 which construct the antenna 10. The embodiment of the antenna arrangement 1 shown in FIG. 3 differs from said embodiment in that it comprises two first radiator elements 2, 2' and two second radiator elements 3, 3'. Said radiator elements construct two antennae, a first antenna 10 and a second antenna 10'.

Both antennae 10, 10' comprise one first radiator element 2, 2' and one second radiator element 3, 3'. Said antennae 10, 10' operate as discussed above, but preferably on different frequency bands.

The resonance frequencies of the antennas are typically in the frequency range of 400 MHz to 2.5 GHz. According to an embodiment the resonance frequency range is 700 to 960 MHz. According to another embodiment the resonance frequency range is 1700 to 2200 MHz. According to a third embodiment, the antenna arrangement comprises two antennae 10, 10', wherein the first antenna 10 is tuned to a first frequency range of 1700 to 2200 MHz and the second antenna 10' is tuned to a second frequency range of 1700 to 2200 MHz.

The antenna arrangement 1 may be adapted to one or more GSM frequency ranges, GSM 850, GSM 900, GSM 1800 and/or GSM 1900, or to a frequency range according to Wi-Fi, Wlan, UMTS, WCDMA, LTE or some other corresponding wireless network technique, for instance. Naturally, other suitable higher frequencies and frequency ranges are also possible.

For example, a single feed antenna arrangement comprising of a helix element as the first radiator element and a second radiator element shown in FIG. 1 may cover both GSM and LTE frequencies at lower frequency range (694 to 960 MHz) and at higher frequency ranges (1710 to 2170 MHz).

The first antenna 10 has smaller dimensions and may be tuned for higher frequency bands, whereas a second antenna 10' has larger dimensions and may be tuned for lower frequency bands.

Both first radiator elements 2, 2' are connected through a feed element 5, 5', respectively, to an antenna port of its own. The second radiator elements 3, 3' are connected through a grounding element 6, 6', respectively, to a ground plane 7. According to another embodiment the first antenna 10 has different ground plane as the second antenna 10'. Said ground planes may be electrically isolated from each other.

It is to be noted here, that in all embodiments the ground plane 7 may be configured not only to a circuit board of the device but also to a display unit, a battery, an auxiliary circuit board etc. and/or other large enough area of conductive material. The ground plane 7 may be manufactured from e.g. copper laminate, flex film, stainless steel, etc.

The antenna arrangement 1 may be located various ways in the electronic device, e.g. in upper end of the device, lower end of the device, in left or right side of the device, and/or in top cover and/or in bottom cover side of the device. The antenna arrangement 1 comprising two or even more antennae 10, 10' may also be located in a decentralised way, e.g. the first antenna 10 in upper end and the second antenna 10' in lower end of the device.

Figure 4:
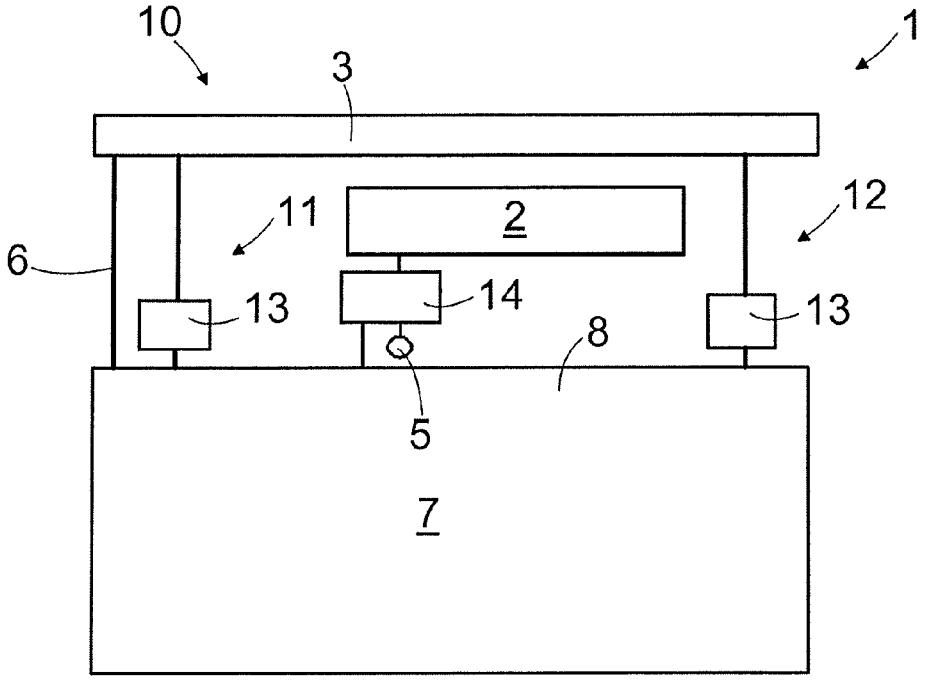
FIG. 4 is a schematic view of fourth example antenna arrangement.

FIG. 4 is a schematic view of fourth example antenna arrangement.

The second radiator element 3 may be connected to a ground plane 7 at more than one point. In the embodiment shown in FIG. 4, the second radiator element 3 is connected through not only a grounding element 6 but also a second 11 and a third 12 grounding element to the ground plane 7. It is to be noted that number of the additional grounding element(s) may be one or more.

The second 11 and a third 12 grounding elements may comprise one or more matching element(s) 13. The matching element 13 may comprise a passive element having e.g. capacitance or inductance, and/or an active element, e.g. a switch or components having variable capacitance.

Also the first radiator element 2 may comprise a second matching element 14 through which it is connected to the ground plane 7.

Figure 5A:
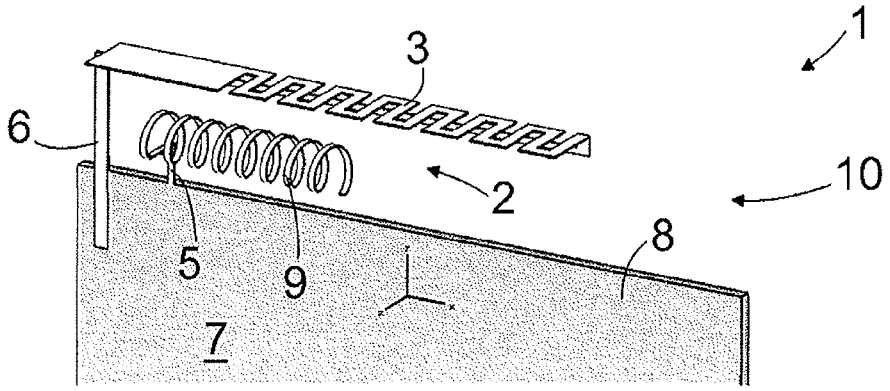
FIGS. 5*a*-5*b* are schematic perspective views of fifth example antenna arrangement.
Figure 5B:
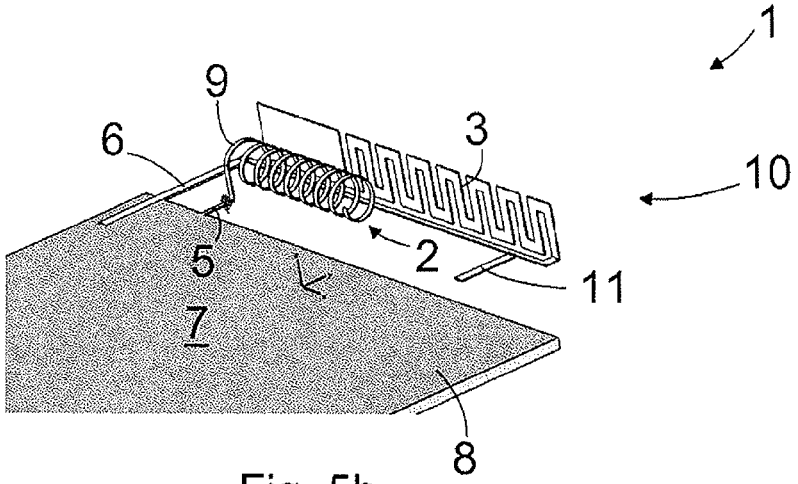

FIGS. 5*a*-5*b* are schematic perspective views of fifth example antenna arrangement. This comprises a meandering element as the second radiator element 3. The main part of the meandering element is arranged in a plane perpendicular to the plane of the ground plane 7, but it also comprises a secondary part that is arranged in a plane parallel with said plane of the ground plane 7.

FIG. 5*b* is showing an optional second grounding element 11 through which the second radiator element 3 may be connected to a ground plane, such as the ground plane 7.

Connections to the electronics of the device, grounding of the second radiator element 3 and features of the first radiator element may be realized as discussed in context with previous FIGS. 1*a*-4.

Figure 6:
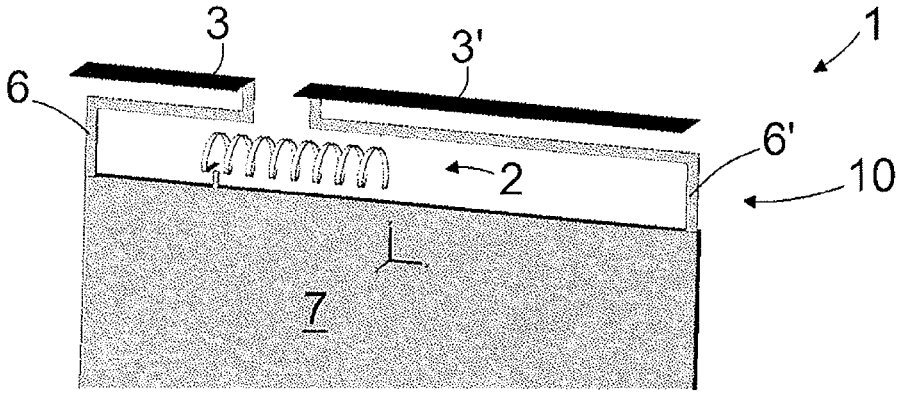
FIG. 6 is a schematic perspective view of sixth example antenna arrangement.

FIG. 6 is a schematic perspective view of sixth example antenna arrangement. This arrangement comprises one first radiator element 2 and two second radiator elements 3, 3'. The second radiator elements 3, 3' are dimensioned and tuned for different frequency ranges.

Figure 7A:
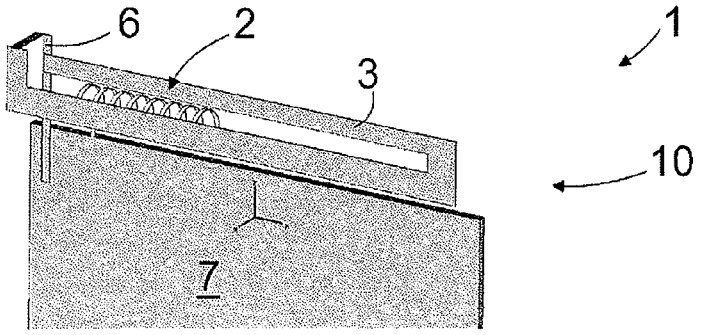
FIGS. 7*a*-7*c* are schematic perspective views of seventh example antenna arrangement.
Figure 7B:
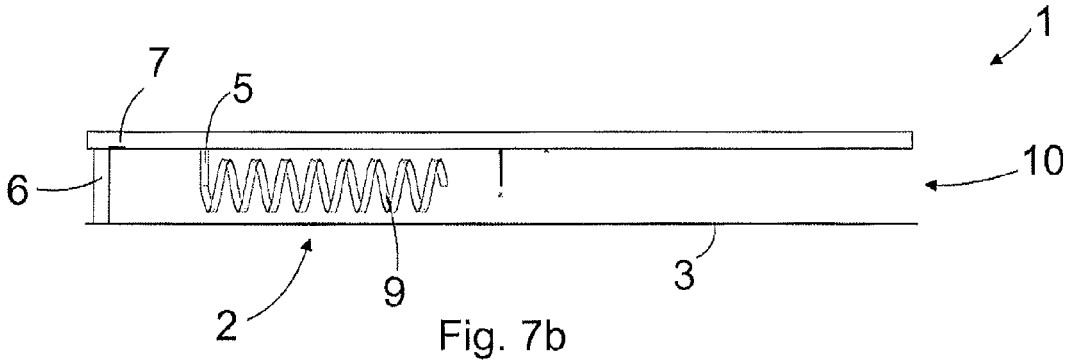
Figure 7C:
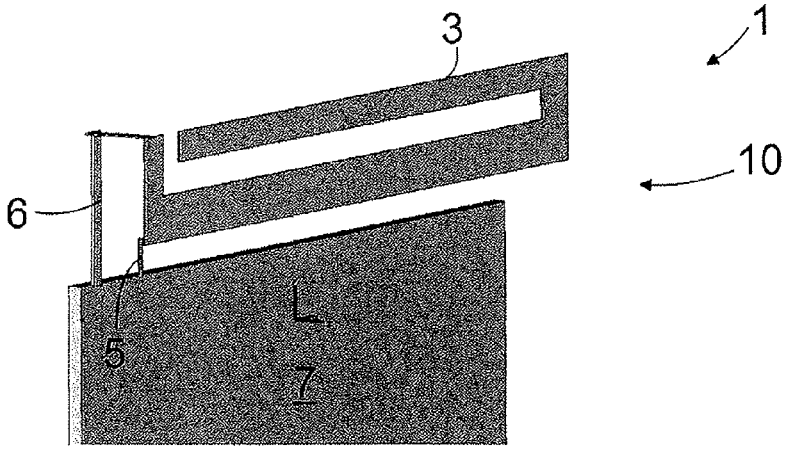

FIGS. 7*a*-7*c* are schematic perspective views of seventh example antenna arrangement. This comprises a planar shape second radiator element 3 that is arranged in a plane parallel with the ground plane 7.

Figure 8A:
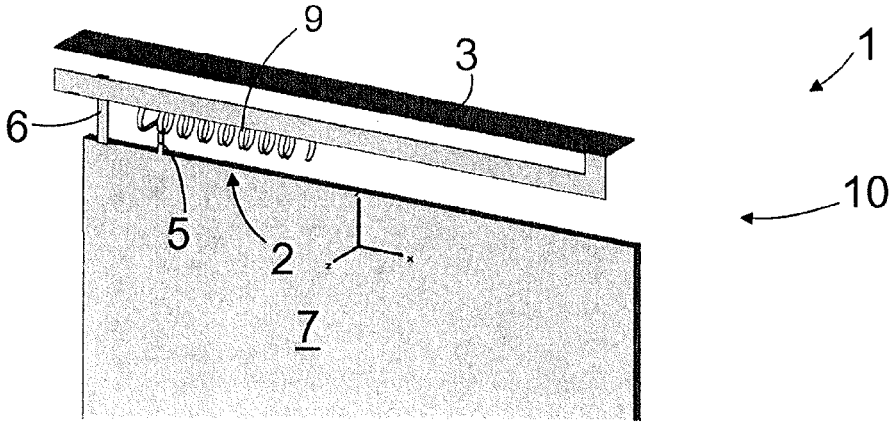
FIGS. 8*a*-8*b* are schematic perspective views of eighth example antenna arrangement.
Figure 8B:
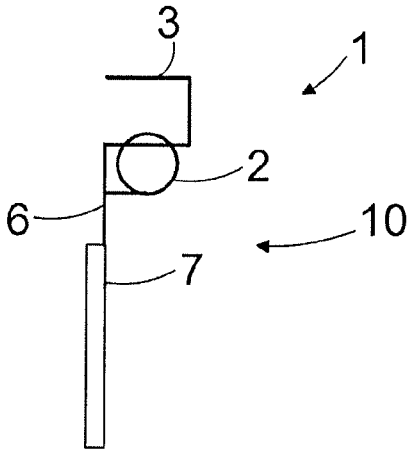

FIGS. 8*a*-8*b* are schematic perspective views of eighth example antenna arrangement. The second radiator element 3 has a shape which is parallel to axis of the helix element 9 and also orthogonal to the axis of the helix antenna.

Figure 9:
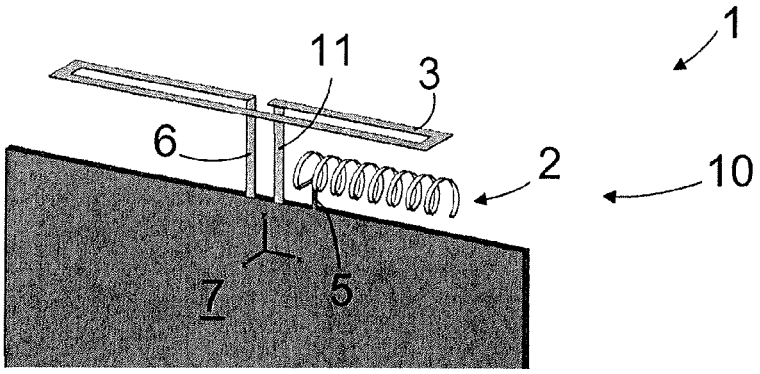
FIG. 9 is a schematic perspective view of ninth example antenna arrangement.

FIG. 9 is a schematic perspective view of ninth example antenna arrangement. Here the second radiator element 3 is a loop or folded dipole type of radiating element. It is grounded by two grounding element 6, 11 to the ground plane 7. It is to be noted that positions of the grounding elements 6, 11 may vary.

In another embodiment the loop or folded dipole type second radiating element 3 is connected to the ground plane by just one grounding element.

Figure 10A:
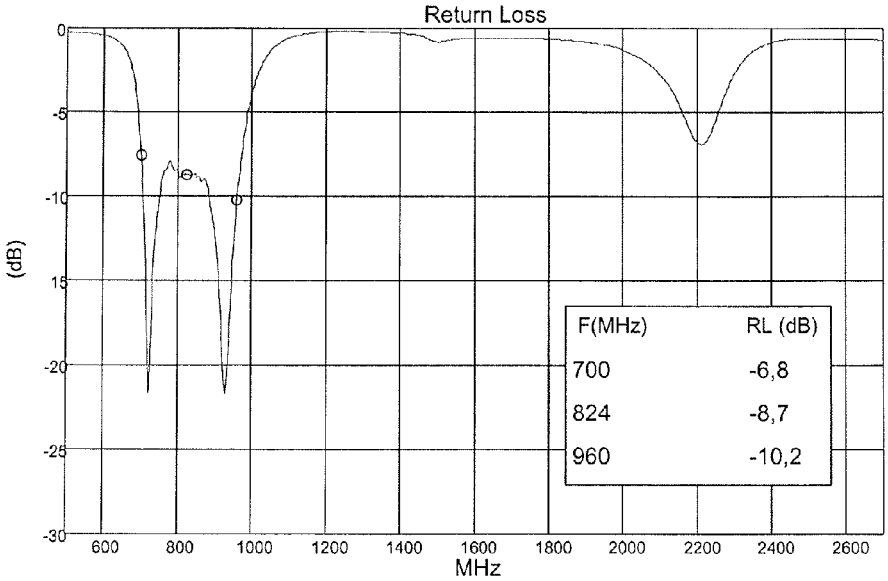
FIGS. 10*a*-10*b* are schematic representations of measurements of properties of an example antenna arrangement.
Figure 10B:
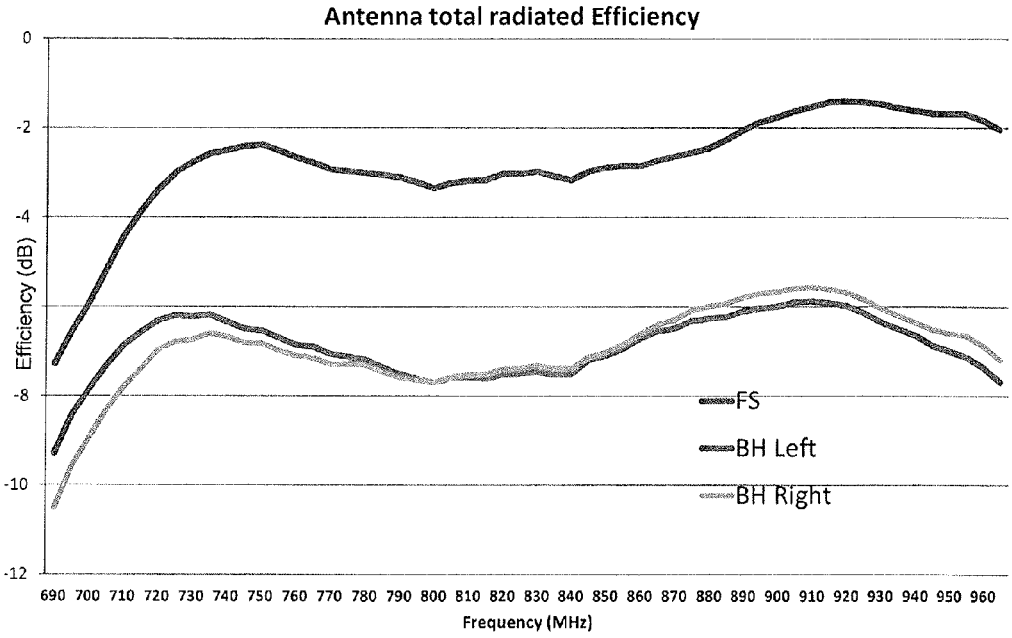

FIGS. 10*a*-10*b* are schematic representations of measurements of properties of an example antenna arrangement.

The layout of the example antenna arrangement 1 was similar to that shown in FIG. 1*a*. The example antenna arrangement 1 comprised a helix element as the first radiator element 2. The helix element 9 consists of copper wire which diameter was 0.4 mm and which was turned in seven turns around a cylindrical carrier element made of plastic. Length of the helix element was 14 mm and diameter of the cylindrical carrier element was 4 mm.

A ground plane 7 was rectangular and its dimensions were 105 mm×55 mm. It was made of 1 mm FR-4 copper laminate.

FIG. 10*a* is showing return loss ($S_{11}$) of the example antenna arrangement. As one can immediately notice, return loss at low frequencies between 700 and 960 MHz is on good level. It is to be noted here that measurements were done with a Network Analyzer which was calibrated to 50 ohm for the measured frequency range.

FIG. 10*b* is showing total radiated efficiency of the example antenna arrangement. It is to be noted that "FS" stands for Free Space. "BH" stands for Beside Head and "Left" and "Right" for which side of the head proto-type was put during the measurements. As can be seen the most important quantity i.e. radiated efficiency in free space is on very good level.

Figure 11A:
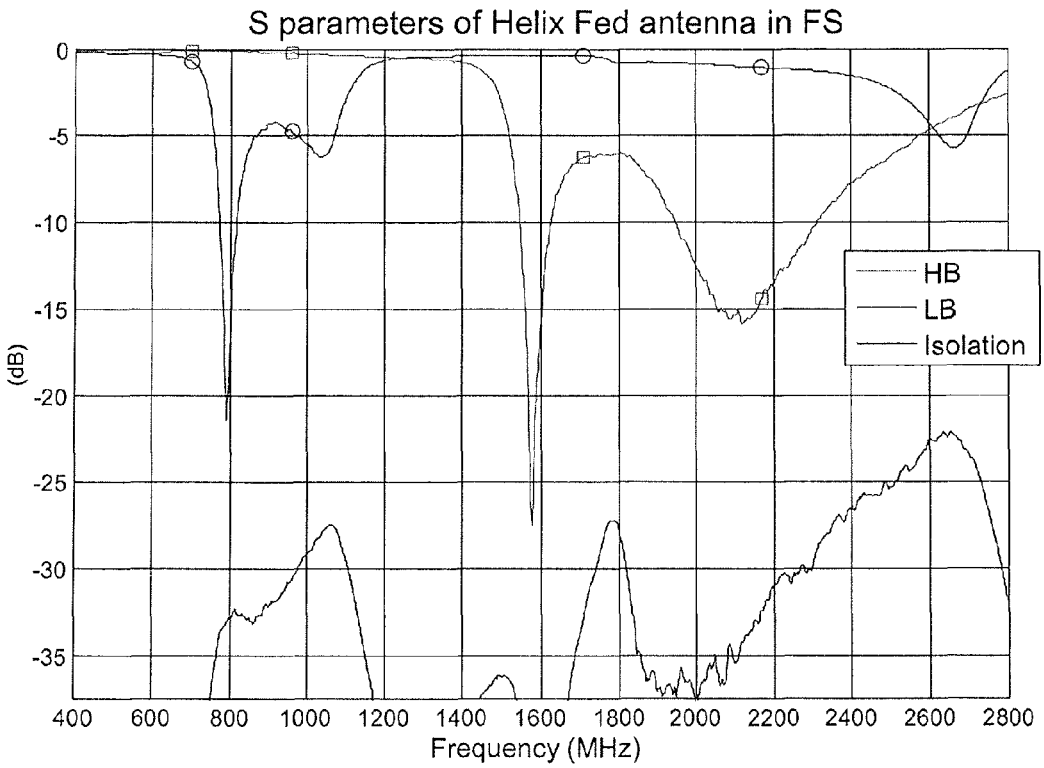
FIGS. 11*a*-11*c* are schematic representations of measurements of another example antenna arrangement.
Figure 11B:
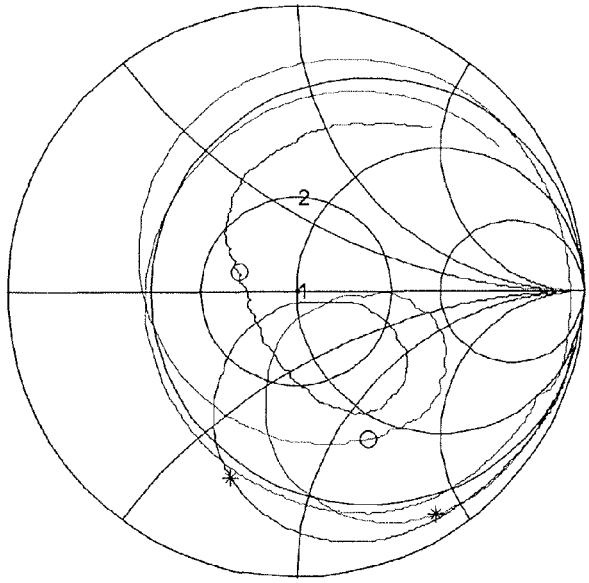
Figure 11C:
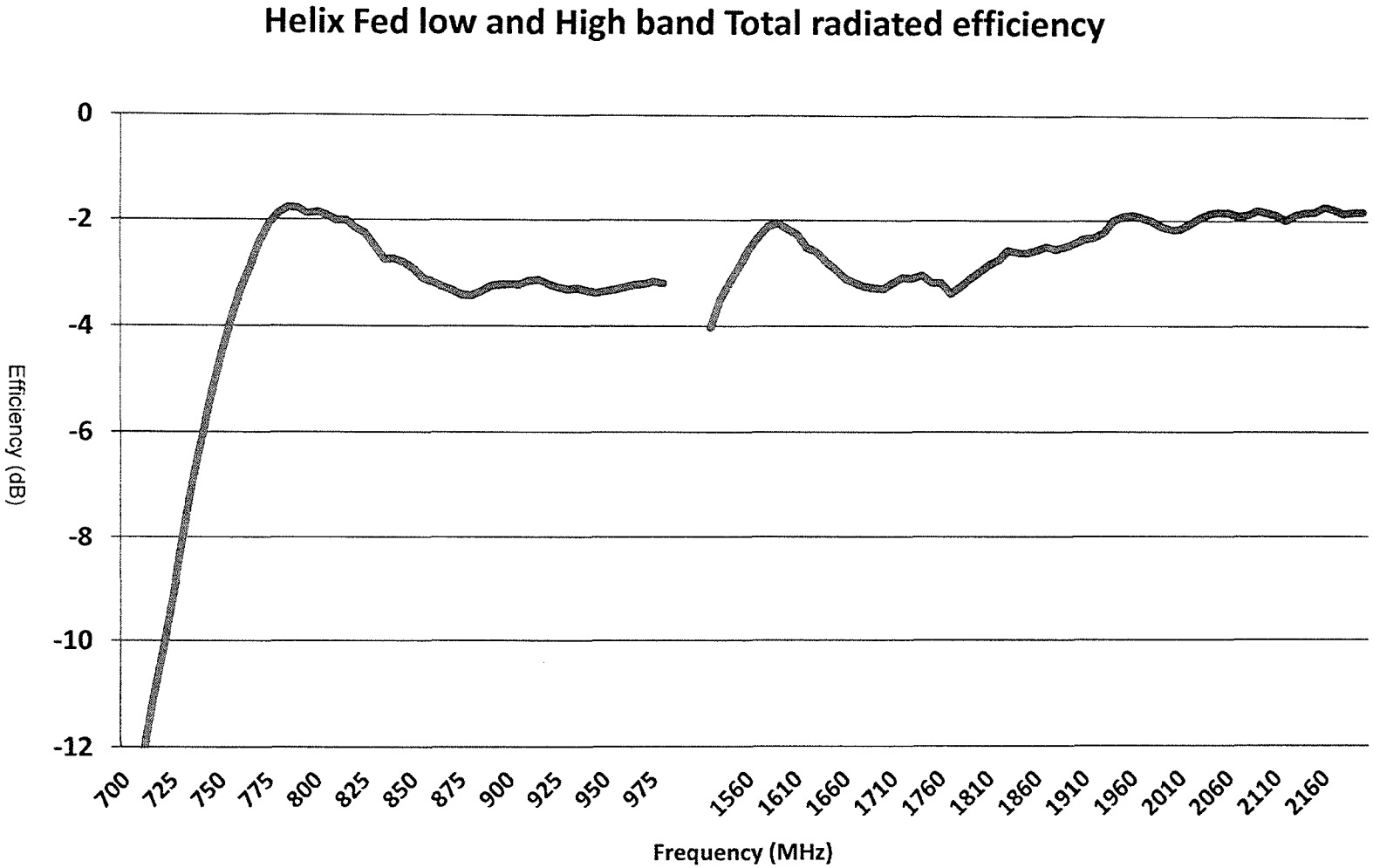

FIGS. 11*a*-11*c* are schematic representations of measurements of second example antenna arrangement.

The layout of the example antenna arrangement 1 was similar to that shown in FIG. 3, i.e. it contained a low band antenna and a high band antenna. Both antennae comprised a helix element as the first radiator element or active element and an inverted L element as a second element or passive element.

The helix elements were made of copper wire diameter of which was 0.4 mm. The helix element of a low band antenna consist of 5.5 turns of the wire and its length was 12 mm and diameter 4 mm.

The helix element of a high band antenna consist of 2.5 turns of the wire and its length was 6 mm and diameter 4 mm.

Antenna height was 5 mm. This is the distance from top of the second radiator element to the ground plane 7.

The ground plane 7 of the antennae was rectangular and its dimensions were 110 mm×55 mm. It was made of 1 mm thick FR4 Copper laminate.

FIG. 11*a* is showing results of S-parameter measurements of the second example antenna arrangement. As can be seen the dual feed solution works well and two antennae designed for certain frequency ranges can be placed close to each other.

FIG. 11*b* is showing an antenna impedance view of the second example antenna arrangement in Smith chart. This shows that the antenna impedance is close to centre of (50 ohm) smith chart, i.e. antenna is well matched.

FIG. 11*c* is showing total radiated efficiency of the second example antenna arrangement. The graph shows that the electrical performance of the antenna arrangement is capable to fulfil demands made for an antenna for mobile phone or other portable electronic device.

The invention is not limited solely to the embodiments described above, but instead many variations are possible within the scope of the inventive concept defined by the claims below. Within the scope of the inventive concept the attributes of different embodiments and applications can be used in conjunction with or replace the attributes of another embodiment or application.

The drawings and the related description are only intended to illustrate the idea of the invention. The invention may vary in detail within the scope of the inventive idea defined in the following claims.

REFERENCE SYMBOLS

1 antenna arrangement
2, 2' first radiator element
3, 3' second radiator element
4 electronic device
5, 5' feed element
6, 6' grounding element
7 ground plane
8 circuit board
9 helix element
10, 10' antenna
11 second grounding element
12 third grounding element
13 matching element

The invention claimed is:

1. An antenna arrangement comprising two radiator elements, a first radiator element of said two radiator elements connected to a feed element, the first radiator element arranged to feed a second radiator element by radiating energy, the second radiator element of said two radiator element being a passive element and connected to a ground plane, and the second radiator element being a meandering element, wherein the first radiator element is a helix element comprising a first helix section and a second helix section, and a pitch space of the first helix section is larger than a pitch space of the second helix section.

2. An antenna arrangement as claimed in claim 1, wherein the second radiator element comprising a main part and a secondary part, and the main part is connected to the secondary part.

3. An antenna arrangement as claimed in claim 1, the second radiator element being an inverted L element.

4. An antenna arrangement as claimed in claim 1, wherein the first radiator element being matched to 50 Ohm through the second radiator element.

5. An antenna arrangement as claimed in claim 1, comprising two first radiator elements and two second radiator elements constructing two antennae.

6. An electronic device, comprising at least two radiator elements, a first radiator element of said two radiator elements connected through a feed element to electronics of the electronic device, the first radiator element arranged to feed a second radiator element by radiating energy, the second radiator element of said two radiator elements being a passive element and connected to a ground plane in the electronic device, and the second radiator element being a meandering element, wherein the first radiator element is a helix element comprising a first helix section and a second helix section, and a pitch space of the first helix section is larger than a pitch space of the second helix section.

7. An electronic device as claimed in claim 6, wherein the second radiator element comprising a main part and a secondary part, and the main part is connected to the secondary part.

8. An electronic device as claimed in claim 6, the second radiator element being an inverted L element.

9. An electronic device as claimed claim 6, the first radiator element being matched to 50 Ohm through the second radiator element.

10. An electronic device as claimed in claim 6, comprising two first radiator elements and two second radiator elements constructing two antennae.

11. An electronic device as claimed in any one of claim 6, the main axis of the first radiator element arranged parallel with the width of the electronic device.

12. An electronic device as claimed in any one of claim 6, the main axis of the first radiator element arranged parallel with the length of the electronic device.

* * * * *